US006578216B1

(12) United States Patent
Aarestad

(10) Patent No.: US 6,578,216 B1
(45) Date of Patent: Jun. 17, 2003

(54) TOROIDAL SHAPED BED CONSTRUCTION

(75) Inventor: Jerome K. Aarestad, Escondido, CA (US)

(73) Assignee: Sunrise Medical HHG Inc., Longmont, CO (US)

( * ) Notice: Subject to any disclaimer, the term of this patent is extended or adjusted under 35 U.S.C. 154(b) by 175 days.

(21) Appl. No.: 09/661,884

(22) Filed: Sep. 14, 2000

Related U.S. Application Data

(60) Provisional application No. 60/153,868, filed on Sep. 14, 1999.

(51) Int. Cl.[7] ..... A61G 7/015

(52) U.S. Cl. ..... 5/618; 5/611; 5/613; 5/186.1; 5/286

(58) Field of Search ..... 5/110, 111, 186.1, 5/286, 611, 618, 112, 119, 312, 613, 616

(56) References Cited

U.S. PATENT DOCUMENTS

| | | | |
|---|---|---|---|
| 197,312 | A | 11/1877 | Barnes |
| 262,302 | A | 8/1882 | Mellon |
| 620,591 | A | 3/1899 | Jackson, Jr. |
| 749,901 | A | 1/1904 | Lewzey |
| 1,425,719 | A | 8/1922 | Swan et al. |
| 2,171,251 | A | 8/1939 | Capron |
| 2,226,165 | A | 12/1940 | Fischer |
| 2,641,777 | A | 6/1953 | Karasek |
| 2,895,144 | A | 7/1959 | Feldman |
| 3,129,441 | A | 4/1964 | Zastera et al. |
| 3,386,113 | A | 6/1968 | Kramer |
| 3,526,910 | A | 9/1970 | Ikeda |
| 3,602,926 | A | 9/1971 | Marini |
| 3,636,574 | A | 1/1972 | Kramer |
| 3,818,518 | A | 6/1974 | Benoit et al. |
| 3,840,913 | A | 10/1974 | Feische |
| 3,950,797 | A | 4/1976 | Bronstien, Jr. |
| 3,983,585 | A | 10/1976 | Sidlinger |
| 4,584,727 | A | 4/1986 | Reiss et al. |
| 4,629,242 | A | 12/1986 | Schrager |
| 4,870,711 | A | 10/1989 | Felix |
| 5,155,881 | A | 10/1992 | Lafferty |
| 5,561,876 | A | 10/1996 | Petruzella |
| 5,678,261 | A | 10/1997 | Han |

*Primary Examiner*—Michael F. Trettel
(74) *Attorney, Agent, or Firm*—MacMillan, Sobanski & Todd, LLC

(57) ABSTRACT

A bed construction wherein a sleep surface has at least one toroidal shaped section, a toroidal shaped main frame supporting the sleep surface, and a pair of opposing toroidal shaped legs supporting the main frame.

12 Claims, 9 Drawing Sheets

TOROIDAL SHAPED BED CONSTRUCTION

CROSS-REFERENCE TO RELATED APPLICATIONS

This application claims the benefit of U.S. Provisional Patent Application No. 60/153,868, filed on Sep. 14, 1999.

BACKGROUND OF THE INVENTION

This invention relates in general to beds and in particular, to bed construction. Most particularly, the invention is related to a toroidal shaped bed construction wherein sleep surface sections, the main frame, and legs are each formed of continuous closed loops constructed of tubular material.

Beds formed from channel members, such as L-channel or C-channel members, are well known. Channel members are cost efficient because they are relatively easy to form and they can easily be cut and joined together. However, channel members flex when subjected to torsional forces. This often results in an unstable bed construction.

To create a more stable bed construction, tubular members have been substituted in the place of channel members. A tubular member does not flex when subject to torsional forces. It is well known to construct sleep surfaces, bed frames, and legs from tubular material. Quite often, such construction is accomplished by adjoining segments of straight or bent polygonal shaped tubular material. The end of one segment is joined to a wall of the another segment. Though the tubular material resists effects of torsional forces, the bed components formed from the joined segment does not.

In an effort to further remedy the effects of torsional forces, or otherwise improve structural integrity of bed components, bed components are reinforced with cross-members. Cross-members, however, interfere with the construction and operation of articulated beds. The location and movement of beds components and actuating members may be dictated by the presence of cross-members.

What is needed is a relatively inexpensive bed construction that resists the effects of torsional forces without interfering with the operation of articulating members.

SUMMARY OF THE INVENTION

The present invention is directed towards a bed construction which resists the effects of torsional forces and which is relatively inexpensive and easy to construct. A bed constructed according to the invention comprises a sleep surface having at least one toroidal shaped section, a toroidal shaped main frame supporting the sleep surface, and a pair of opposing toroidal shaped legs supporting the main frame.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
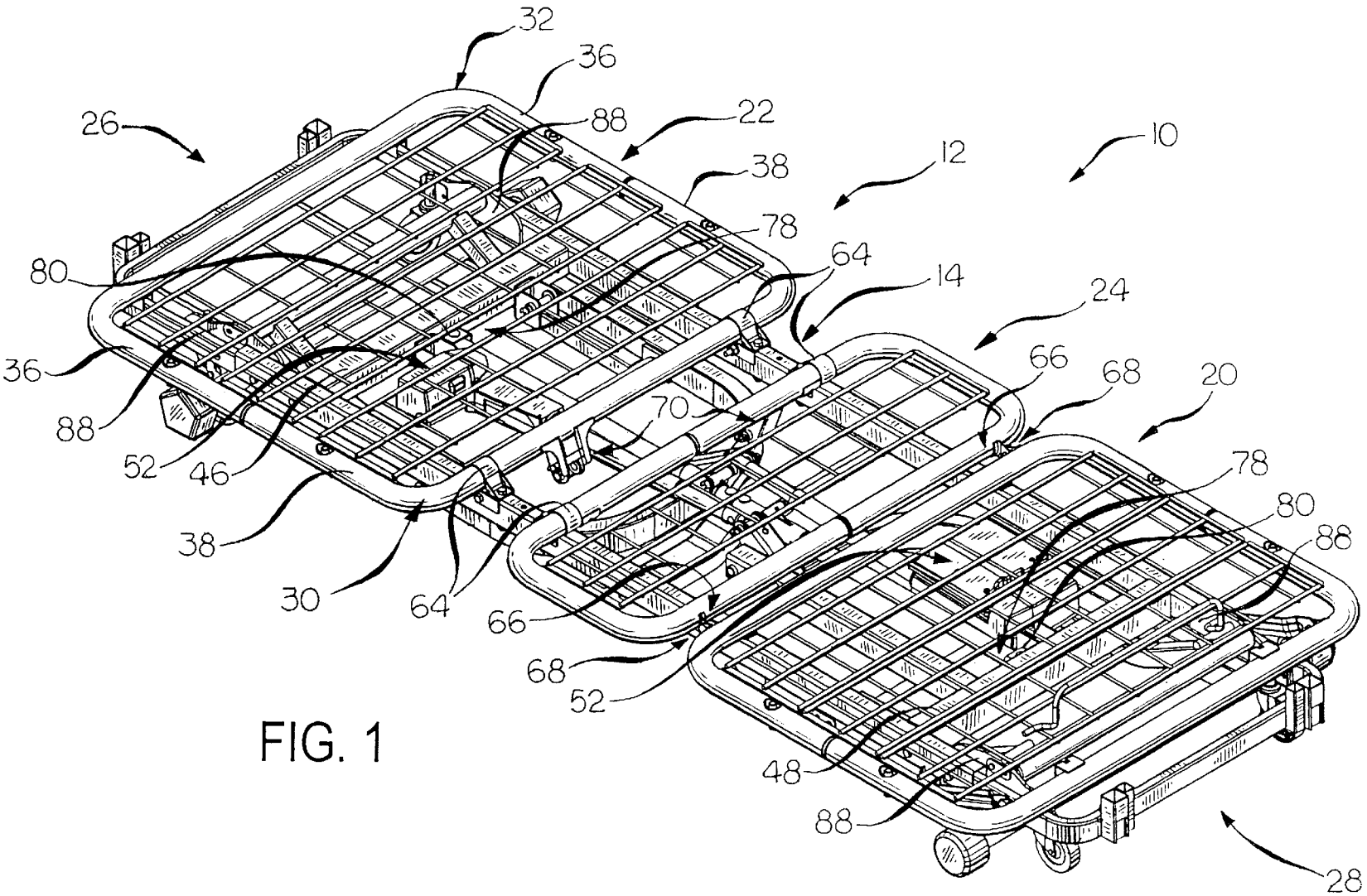
FIG. 1 is a perspective view of an articulated bed in a lowered position.
Figure 2:
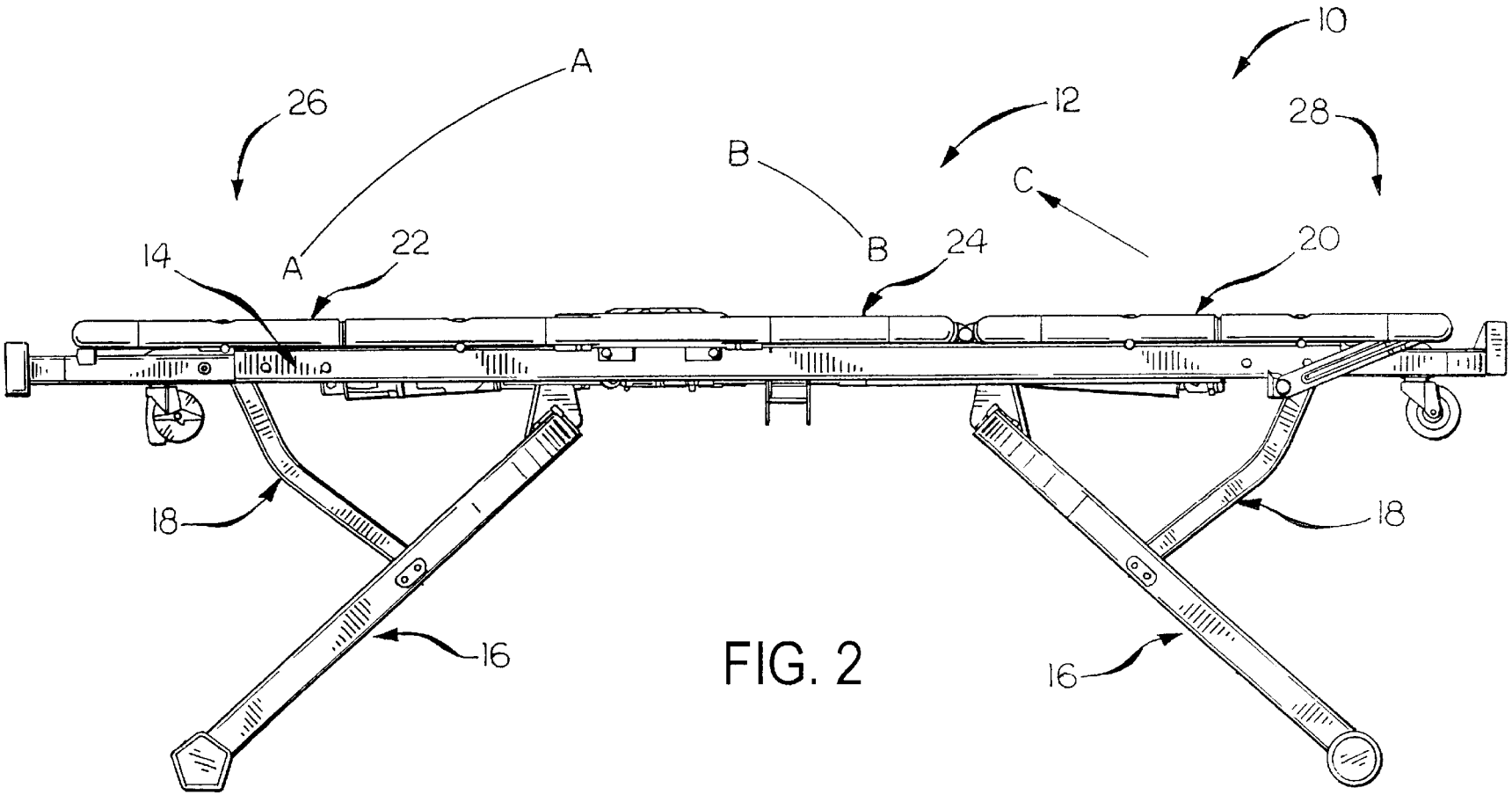
FIG. 2 is a side elevational view of the bed shown in FIG. 1 in a raised position.

There is illustrated in FIGS. 1 and 2 a bed 10 comprising a sleep surface 12 supported by a main frame 14. The main frame 14 is supported by a pair of opposing legs 16 and corresponding stabilizers 18. The sleep surface 12 preferably includes at least three sections; namely, a head or back section 20, a leg or foot section 22, and a knee section 24 disposed between the head and foot sections 20, 22. The main frame 14 is located below the sleep surface 12 to provide subjacent support for the sleep surface 12. The legs 16 are located below the main frame 14 to provide subjacent support for the main frame 14.

As will become more apparent in the description that follows, the head and knee sections 20, 24 are preferably pivotally attached to the main frame 14 so as to be movable relative to the main frame 14. The foot section 22 is pivotally attached to the knee section 24 to move in response to movement of the knee section 24. The legs 16 and corresponding stabilizers 18 are likewise pivotally attached to the main frame 14 to move relative to the main frame 14.

The head and knee sections 20, 24 are movable between a lowered position and a raised, inclined position. This permits the orientation of a bed occupant's head or back and upper legs or knees to be varied relative to the main frame 14. The foot section 22 is movable relative to the main frame 14 and the knee section 24 in response to movement of the knee section 24. This permits the orientation of the bed occupant's lower legs and feet to be varied relative to the main frame 14.

The legs 16 and corresponding stabilizers 18 and the main frame 14 are all movable relative to one another to permit the orientation of the main frame 14 to be varied relative to a support surface. For example, the entire main frame 14 may be lowered or raised relative to the supporting surface by raising and lowering both the head end, generally indicated at 26, and the foot end, generally indicated at 28, of the main frame 14. Alternatively, either the head end or the foot end 26, 28 of the main frame 14 may be lowered or raised to orient the main frame 14 at an angle relative to the supporting surface.

It is most preferable that undesirable movement of the sections 20, 22, 24 of the sleep surface 12, the main frame 14, and the legs 16 and stabilizers 18 be eliminated or significantly reduced to provide stable support for a bed occupant. It is also preferable that the sections 20, 22, 24 of the sleep surface 12, the main frame 14, and the legs 16 and stabilizers 18 refrain from producing noise. Noise is ordinarily produced as a result of longitudinal or lateral deflection of the sections of the sleep surface 12, the main frame 14, and the legs 16 and stabilizers 18. Longitudinal and lateral deflection may occur as a result of torsional forces acting upon the sections 20, 22, 24 of the sleep surface 12, the main frame 14, and the legs 16 and stabilizers 18. To reduce the effect of torsional forces acting upon the sections 20, 22, 24 of the sleep surface 12, the main frame 14, and the legs 16 and stabilizers 18, the sections 20, 22, 24 of the sleep surface 12, the main frame 14, and the legs 16 and stabilizers 18 are all constructed so as to be toroidal in shape. The term "toroidal" in this context is intended to mean that the sections 20, 22, 24 of the sleep surface 12, the main frame 14, and the legs 16 and stabilizers 18 are each continuous closed loops or hoops constructed of tubular material. The tubular material of the sections 20, 22, 24 of the sleep surface 12 preferably has a round cross-section. The tubular material of the main frame 14 and the legs 16 and stabilizers 18 preferably has a rectangular cross-section. It should be understood that tubular materials having various other cross-sections may be suitable for carrying out the invention. However, a critical aspect of the invention is that the sections 20, 22, 24 of the sleep surface 12, the main frame 14, and the legs 16 and stabilizers 18 each be in the form of a continuous closed hoop. The continuous closed hoops may be formed as follows.

Figure 3:
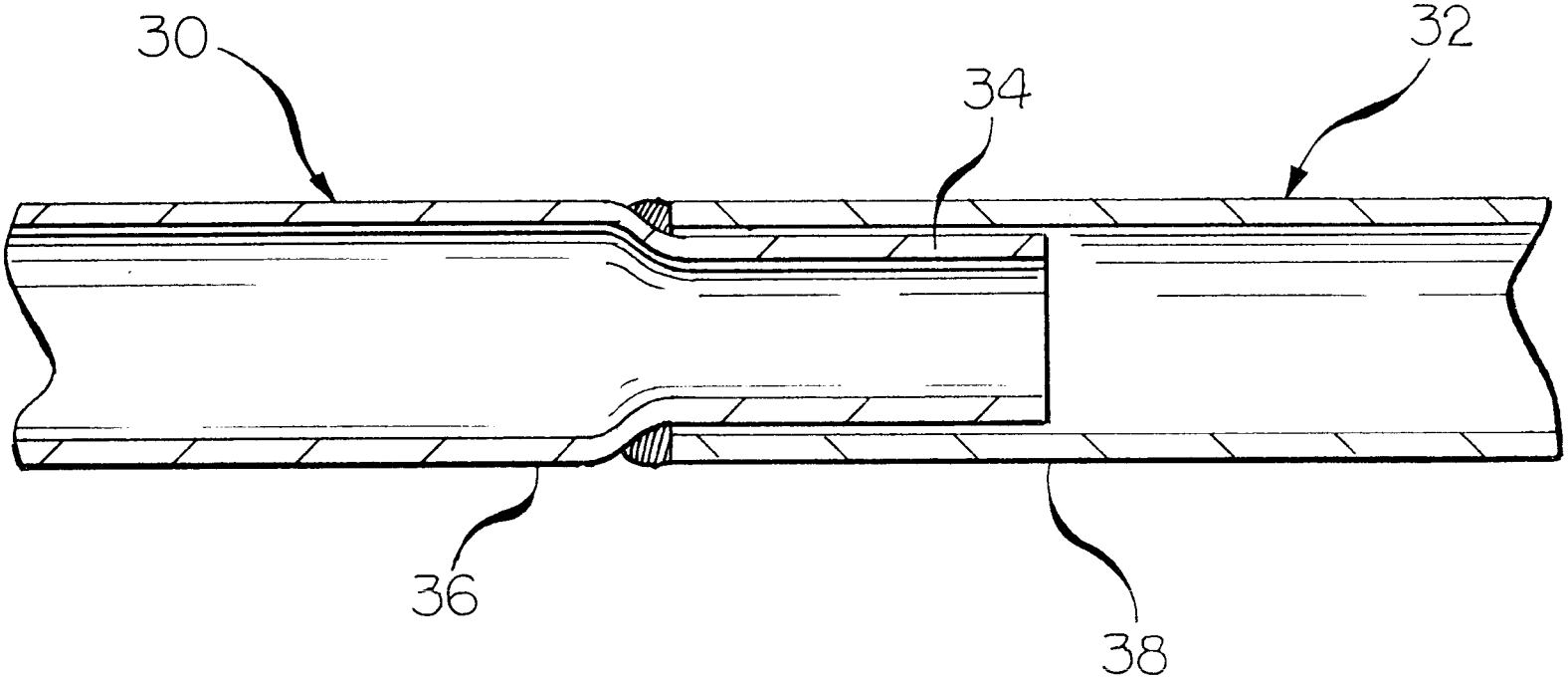
FIG. 3 is an enlarged sectional view of a joint for engaging legs of opposing U-shaped members of a sleep surface section shown in FIGS. 1 and 2.

Beginning with the sections 20, 22, 24 of the sleep surface 12, each section 20, 22, 24 may be formed of a pair of opposing U-shaped tubular members. To simplify the description, the formation of a single bed section 20 will be provided. It should be understood that the other sections 22, 24 may be formed in a similar manner. It should further be understood that the formation of the sections 20, 22, 24 is not limited to the manner described herein below. Certainly other manners of forming sections 20, 22, 24 in the form of closed hoops may be suitable for carrying out the invention. Now with regard to the head section 20, U-shaped tubular members 30, 32 (shown in FIG. 1) are constructed to be engageable with one another. The engagement of the U-shaped tubular members 30, 32 may be accomplished by providing a reduced diameter portion 34 at the end of each leg 38 of one of the U-shaped tubular members 30, 32, as shown in FIG. 3. Each reduced diameter portion 34 is adapted to be received by a corresponding leg 38 of the opposing U-shaped tubular member 32. It is preferable that the outside diameter of the reduced diameter portions 34 and the inside diameter of the legs 38 of the opposing U-shaped tubular member 32 be machined or dimensioned within a close tolerance of one another. It is desirable that the reduced diameter portions 34 fit tightly within the legs 38 of the opposing U-shaped tubular member 32 so that slip or slop does not exist between the engaged legs 36, 38. In other words, the opposing legs 36, 38 should engage one another tightly enough to ensure that longitudinal or lateral or torsional movement does not occur.

After engaging the opposed legs 36, 38, the legs 36, 38 are fixed relative to one another, preferably by welding the opposed legs 36, 38 together. Although other means may be suitable for fixing the legs 36, 38 relative to one another, welding the opposed legs 36, 38 about the periphery of the legs 36, 38 at the end of the receiving legs 36, 38 fixes the legs 36, 38 together so that the fixed legs 36, 38 resist effects of torsional forces. It is conceivable that the legs 36, 38 may be fixed together in other manners, such as fusing or adhering the legs 36, 38 together, or attaching the legs 36, 38 together with a fastener that resists effects of torsional forces. However, it is critical that the manner in which the legs 36, 38 are fixed together resists effects of torsional forces. By fixing the two U-shaped tubular members 30, 32 together, a continuous closed hoop is formed.

Figure 4:
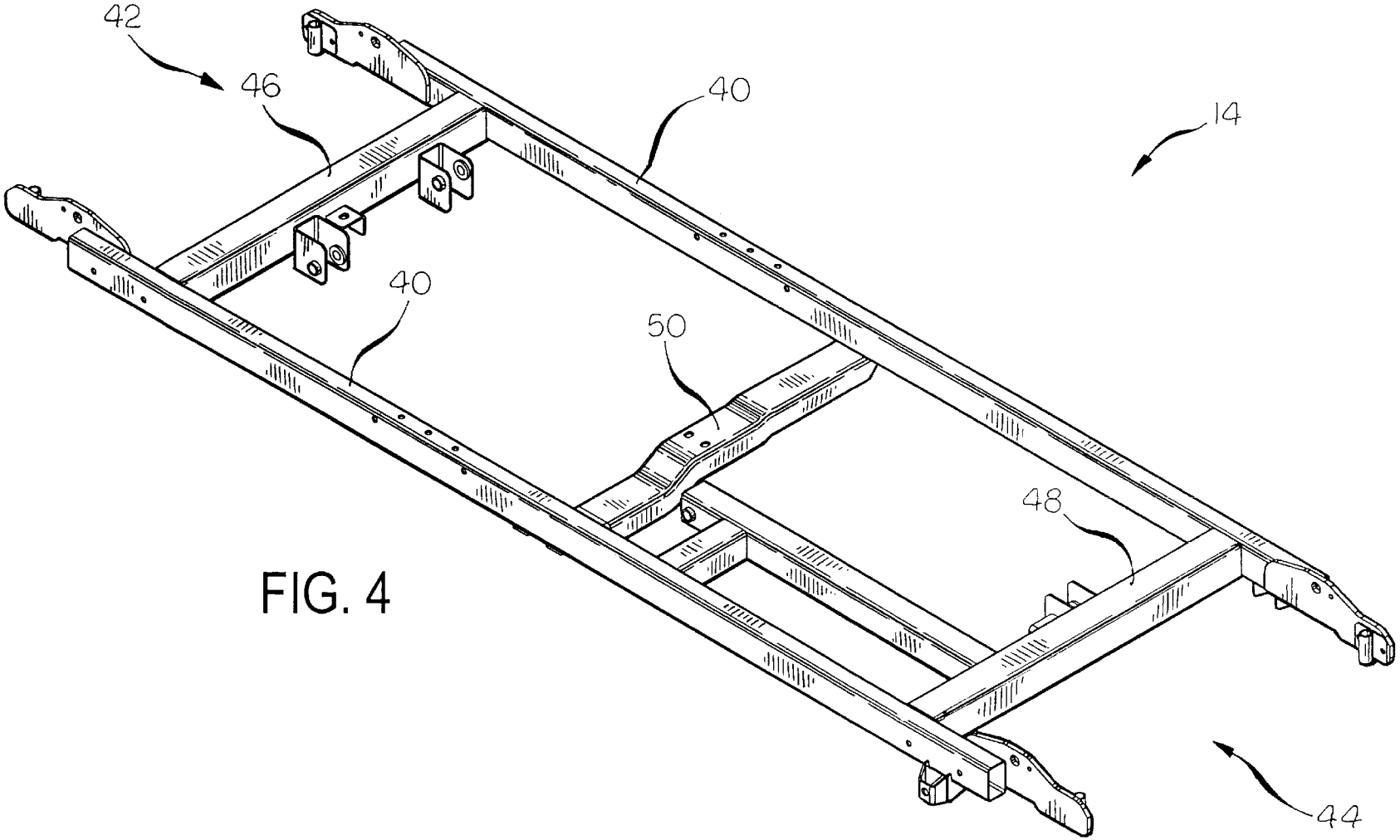
FIG. 4 is a perspective view of the main frame shown in FIGS. 1 and 2.

A main frame 14 having a continuous closed hoop construction may be formed as follows. The main frame 14 may include opposing side rails 40 each having a head end 42 and a foot end 44, as shown in FIG. 4. A portion proximate the head end 42 of the opposing side rails 40 may be joined together by a cross-member, such as the head tube 46 shown. Similarly, a portion proximate the foot end 44 of the opposing side rails 40 may be joined together by a cross-member, such as the foot tube 48 shown. The opposing side rails 40 and the head and foot tubes 46, 48 cooperate to form a continuous closed hoop.

The opposing ends of the head and foot tubes 46, 48 may be joined perpendicularly to respective portions of corresponding side rails 40. A perpendicular joint between the head and foot tubes 46, 48 and the side rails 40 is simple to produce. In addition, such joints conserve materials. Moreover, perpendicular joints provide a sturdy structure for supporting a bed occupant.

Figure 9:
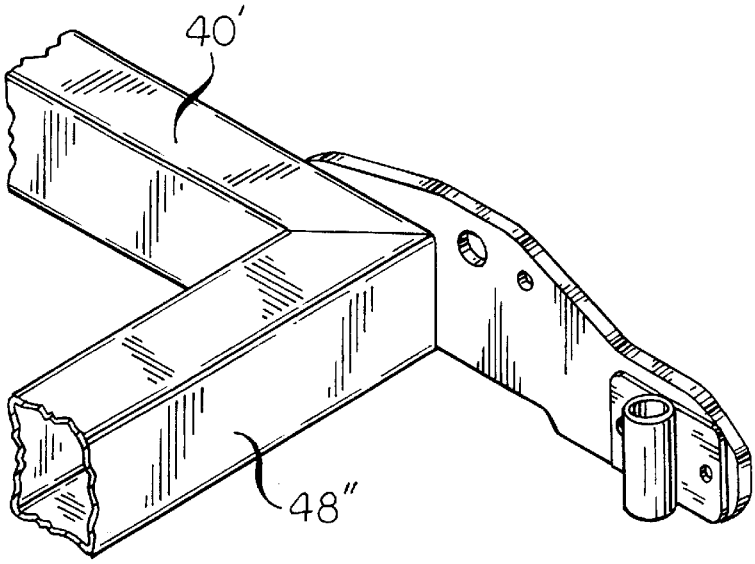
FIG. 9 is an enlarged partial perspective view of a corner of the main frame of the bed.
Figure 10:
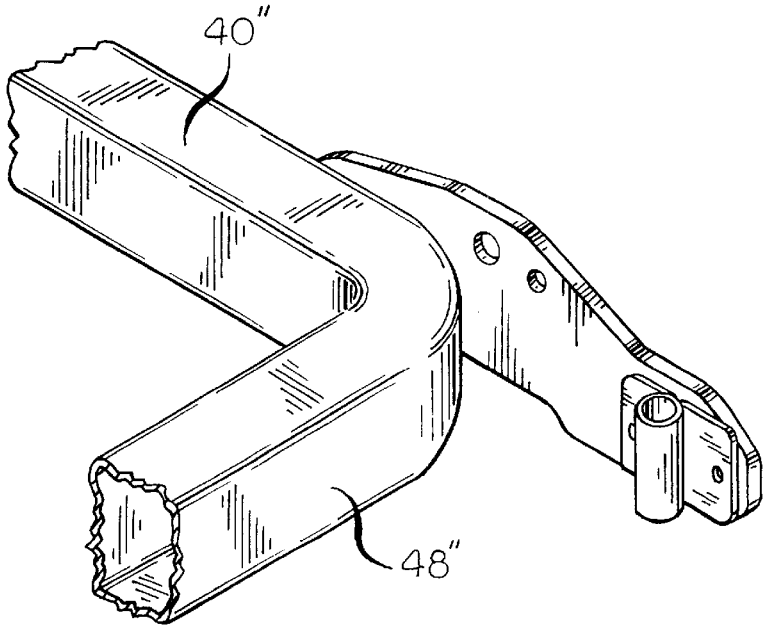
FIG. 10 is an enlarged partial perspective view of a corner of an alternative main frame of the bed.

Alternative frame configurations are shown in FIGS. 9 and 10. In FIG. 9, the ends of the side rails 40 and the head and foot tubes 46, 48 are mitered at 45 degrees so that they may be joined perpendicularly and form a continuous hoop. In FIG. 10, the head and foot tubes 46, 48 are formed integrally with the side frames 40 by bending the tubular material. The main frame of FIG. 10 may be formed into a closed hoop in a manner similar to the sections 20, 22, 24 of the sleep surface 12.

The opposing side rails 40 and the head and foot tubes 46, 48 may be fixed together in any suitable manner, such as welding, fusing, or adhering the opposing side rails 40 and the head and foot tubes 46, 48 together. The head and foot tubes 46, 48 may be fixed to the opposing side rails 40 by welding opposing ends of the head and foot tubes 46, 48 perpendicular to the side rails 40. Welding is a simple, relatively low-cost manner of fixing the head and foot tubes 46, 48 to the side rails 40. Moreover, welding produces a stronger joint than alternative forms of attachment, such as threaded fasteners and the like.

Unlike the sections 20, 22, 24 of the sleep surface 12, the side rails 40 and the head and foot tubes 46, 48 have rectangular cross-sections. It is preferable that the side rails 40 and the head and foot tubes 46, 48 have a rectangular cross-section because substantially flat outer surfaces (shown but not referenced) of such a cross-section may be well suited for the attachment of auxiliary component parts, such as brackets and clamps (not shown).

A continuous hoop having a rectangular cross-section, such as is formed by the side rails 40 and the head and foot tubes 46, 48, resists the effects of torsional forces just as a continuous hoop having a round cross-section, such as the sections 20, 22, 24 of the sleep surface 12 described above.

The invention is not intended to be limited to the main frame 14 described above. The main frame 14 can be a continuous hoop formed of one or more tubular members. The main frame 14 may be formed in a manner similar to that of the sections 20, 22, 24 of the sleep surface 12 described above. That is to say, the main frame 14 can be a continuous hoop formed of opposing U-shaped tubular members having opposing legs welded together. Regardless of the manner in which the main frame 14 is formed, it is critical that the main frame 14 be formed in the shape of a continuous hoop so as to resist the effects of torsional forces.

To further resist the effects of torsional forces, the structural integrity of the main frame 14 may be increased with one or more cross-members. One such channel is the high/low support channel 50 shown in the drawings. The high/low support channel 50 spans the opposing side rails 40 and is joined to the side rails 40. The high/low support channel 50 may be joined to the side rails 40 in a manner similar to the above-described manner in which the head and foot tubes 46, 48 are joined to the side rails 40. Although the high/low support channel 50 may increase the structural integrity of the main frame 14, the main purpose of the high/low support channel 50 is to support, among other components, actuators 52 that are provided to raise and lower the main frame 14 and articulate the head and knee sections 20, 24 of the sleep surface 12.

Figure 5:
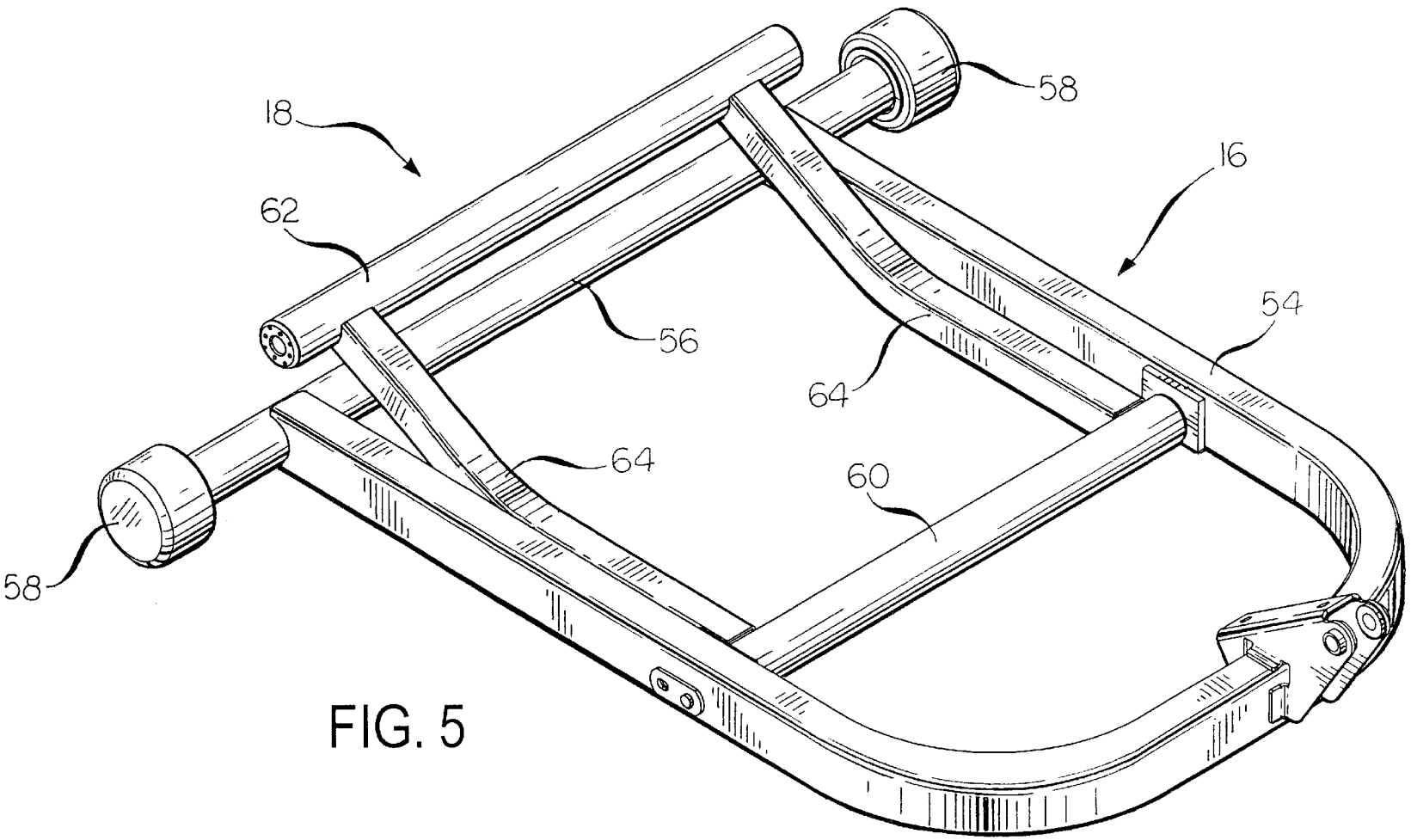
FIG. 5 is a perspective view of a leg and a stabilizer shown in FIG. 2.

Lastly, the legs 16 and corresponding stabilizers 18 may be formed as follows. Each leg 16 is preferably formed of a bent leg tube 54 and a laterally extending foot tube 56, as shown in FIG. 5. The foot tube 56 is attached to the opposing legs (shown but not referenced) of the bent leg tube 54. The foot tube 56 is preferably welded perpendicularly to the ends of the legs of the bent leg tube 54 to produce a leg weldment. The lateral extent of the foot tube 56 may exceed the width of the bent leg tube 54. In this way, opposing ends (shown but not referenced) of the foot tube 56 may extend laterally beyond the legs of the bent leg tube 54. It is contemplated that the wheels 58 be attached to the opposing ends of the foot tube 56. The extent to which the opposing ends of the foot tube 56 extend beyond the bent leg tube 54 provides clearance between the wheels 58 and the bent leg tube 54.

Each stabilizer 18 preferably includes a pair of spaced pivot tubes including a short pivot tube 60 and a long pivot tube 62. The pivot tubes 60, 62 are joined together by opposing stabilizer leg tubes 64. Opposing ends (shown but not referenced) of the stabilizer leg tubes 64 are joined to the pivot tubes 60, 62 so as to form a continuous hoop. The stabilizer leg tubes 64 are preferably welded to the pivot tubes 60, 62 because welding provides a substantially rigid structure at a relatively low cost. The short pivot tube 60 is dimensioned to fit between the legs of the bent leg tube 54. The long pivot tube 62 is dimensioned to fit between the side rails 40 of the main frame 14.

Once the toroidal or hoop-shaped sleep surface 12, main frame 14, legs 16, and stabilizers 18 are formed, the bed 10 may be assembled. The head and knee sections 20, 24 of the sleep surface 12 may be pivotally attached to the main frame 14 so as to be pivotally supported above the main frame 14. The legs 16 and stabilizers 18 are pivotally attached to opposing ends of the main frame 14 to provide subjacent support for the main frame 14.

Figure 6:
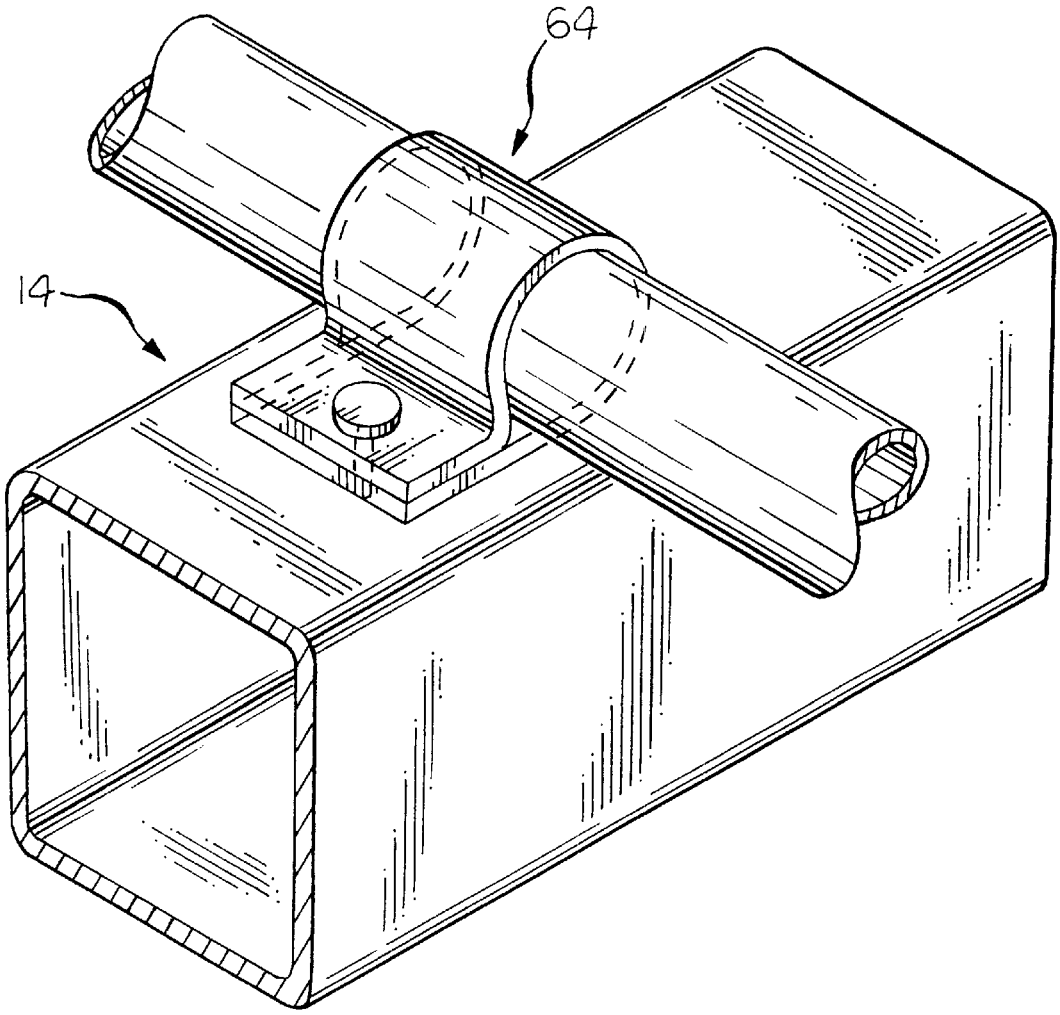
FIG. 6 is an enlarged perspective view of a connection for pivotally attaching a sleep surface section shown in FIGS. 1 and 2 to the main frame.

The head and knee sections 20, 24 may be pivotally attached to the main frame 14 in any suitable manner. For example, clamps 64, such as the P-clamps shown in FIG. 6, may be used to pivotally attach the head and knee sections 20, 24 to the main frame 14. The clamps 64 should be adapted to receive a laterally extending portion or segment of the head and knee sections 20, 24 and permit the head and knee sections 20, 24 to pivot. It is preferable that the head and knee sections 20, 24 pivot along the lines A—A and B—B within the clamps 64 (shown in FIG. 1).

The foot section 22 is pivotally attachable to the knee section 24. This may be accomplished in any suitable manner. One manner of attaching the foot and knee sections 22, 24 is as follows. The knee section 24 may be provided with a pair of laterally spaced knee pivot brackets 66 (shown in FIG. 1). Similarly, the foot section 22 may be provided with a pair of laterally spaced foot pivot brackets 68. Each knee pivot bracket 66 has a hole (not shown) adapted to align with a hole (also not shown) in a corresponding one of the foot pivot brackets 68. A rivet (not clearly shown) is adapted to be received by each set of co-aligning holes to pivotally attach the knee and foot pivot brackets 66, 68. The holes in the knee pivot brackets 66 may be smaller or larger than the holes in the foot pivot brackets 68. A stepped rivet may be inserted into the aligned holes so that a larger diameter portion of the stepped rivet is received by the larger hole and a smaller diameter portion of the stepped rivet is received by the smaller hole. This arrangement would provide a tight connection between the knee and foot sections 24, 22 yet permit the knee and foot sections 24, 22 to freely pivot relative to one another. The pivotal attachment between the knee and foot sections 24, 22 permits the foot section 22 to move in response to movement of the knee section 24. For example, as the knee section 24 is raised or pivoted upward, the foot section 22 may follow in the direction of the arrow C. As the knee section 24 is lowered or pivoted downward, the foot section 22 may return to a lowered position in a direction opposite to the direction of the arrow C.

The head and knee sections 20, 24 of the sleep surface 12 are preferably pivotally attached to the main frame 14 so that play between the clamps 64 is minimized. In other words, it is preferable that slop between the head and knee sections 20, 24 and the clamps 64 be substantially reduced or eliminated. The reduction or elimination of slop reduces the risk that longitudinal and lateral deflection of the sleep surface sections 20, 24, 22 will occur.

The risk of slop between the clamps 64 and the head and knee sections 20, 24 may be reduced by machining the clamps 64 within a close tolerance of the lateral portions of the head and knee sections 20, 24. To further reduce the risk of slop between the clamps 64 and head and knee sections 20, 24, a low-friction material (not shown) may be provided between the clamps 64 and the head and knee sections 20, 24. A low-friction material, such as a nylon film (not shown), may permit the clamps 64 to be secured very tightly to the head and knee sections 20, 24 while the head and knee sections 20, 24 are still permitted to pivot.

With regard to the legs 16, the bent leg tube 54 of each leg 16 has an upper portion that is longitudinally displaceable relative to the main frame 14. A medial portion of the bent leg tube 54 is pivotally connected to the short pivot tube 60. A lower end of the bent leg tube 54 is attached to the long pivot tube 62, which, in turn, supports a pair of wheels 58.

Figure 7:
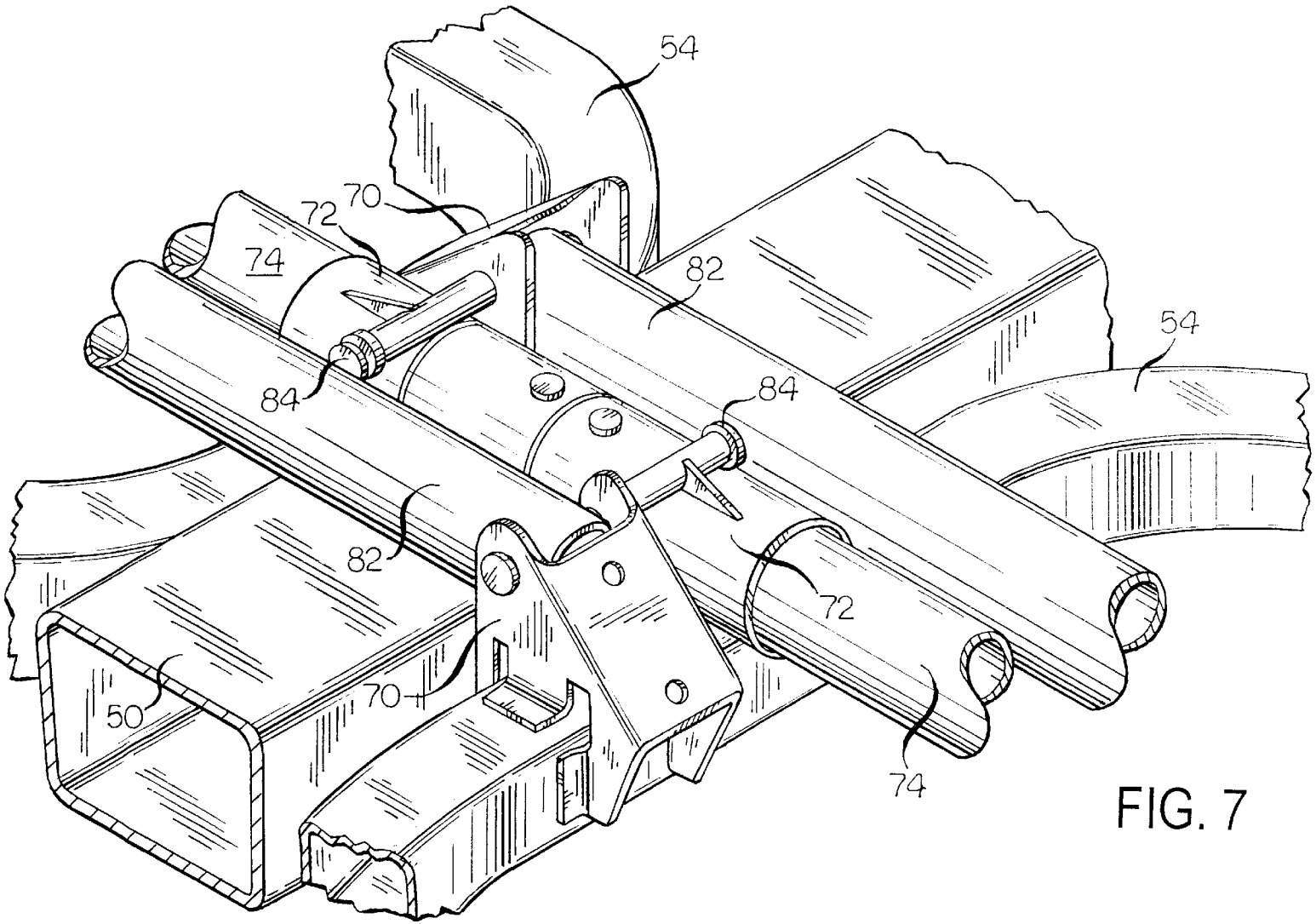
FIG. 7 is an enlarged perspective view of a movable pivot connection between the leg and the main frame shown in FIG. 2.

The longitudinal displacement of the upper portion of the bent leg tube 54 may be achieved in any suitable manner. One manner in which such longitudinal displacement may be achieved is as follows. The upper portion may be provided with a yoke 70, as shown in FIG. 7, that is adapted to support a slideable element, such as the slider 72 shown. The slider 72 may be slideably engageable with a support member, such as the slider tube 74 shown. The slider tube 74 is preferably a substantially linear, longitudinally disposed tube having opposing ends 76, 78 (one end 78 of the slider tube 74 is shown in FIG. 1). One end 76 is engageable with the high/low support channel 50. The other end 78 is engageable with a slider tube bracket 80. A slider tube bracket 80 is attached to the head and foot tubes 46, 48. Although the slider tube bracket 80 may be attached in any suitable manner, it is most preferable that the bracket 80 be welded to the head and foot tubes 46, 48. The ends 76, 78 of the slider tube 74 may be fastened to the high/low support channel 50 and the slider tube bracket 80 in any suitable manner. However, threaded fasteners are most preferred.

The yoke 70 is further adapted to receive the actuator rod 82 of an actuator 52 (shown in FIG. 1). The actuator rod 82 is preferably pivotally connected to the yoke 70. This pivotal connection may be achieved as follows. The yoke 70 may be provided with holes for receiving a pivot pin 84. Bushings may be supported by the yoke 70 so as to align with the holes in the yoke 70. An end portion of the actuator rod 82 may also be provided with a hole that is adapted to receive the pivot pin 84. The pivot pin 84 is inserted into and through the holes in the yoke 70 and the end portion of the actuator rod 82 to pivotally attach the actuator rod 82 to the yoke 70. A portion of the pivot pin 84 may extend laterally beyond the yoke 70 to pivotally engage a hole in the slider 72 to pivotally support the slider 72 adjacent the yoke 70. The slider 72, in turn, is slideable engageable with the slider tube 74, as set forth above. It is preferable that the holes in the yoke 70, the end portion of the actuator rod 82, and the slider 72 be machined within a close tolerance of the pivot pin 84 to reduce the risk of slop between the holes and the pivot pin 84.

Figure 8:
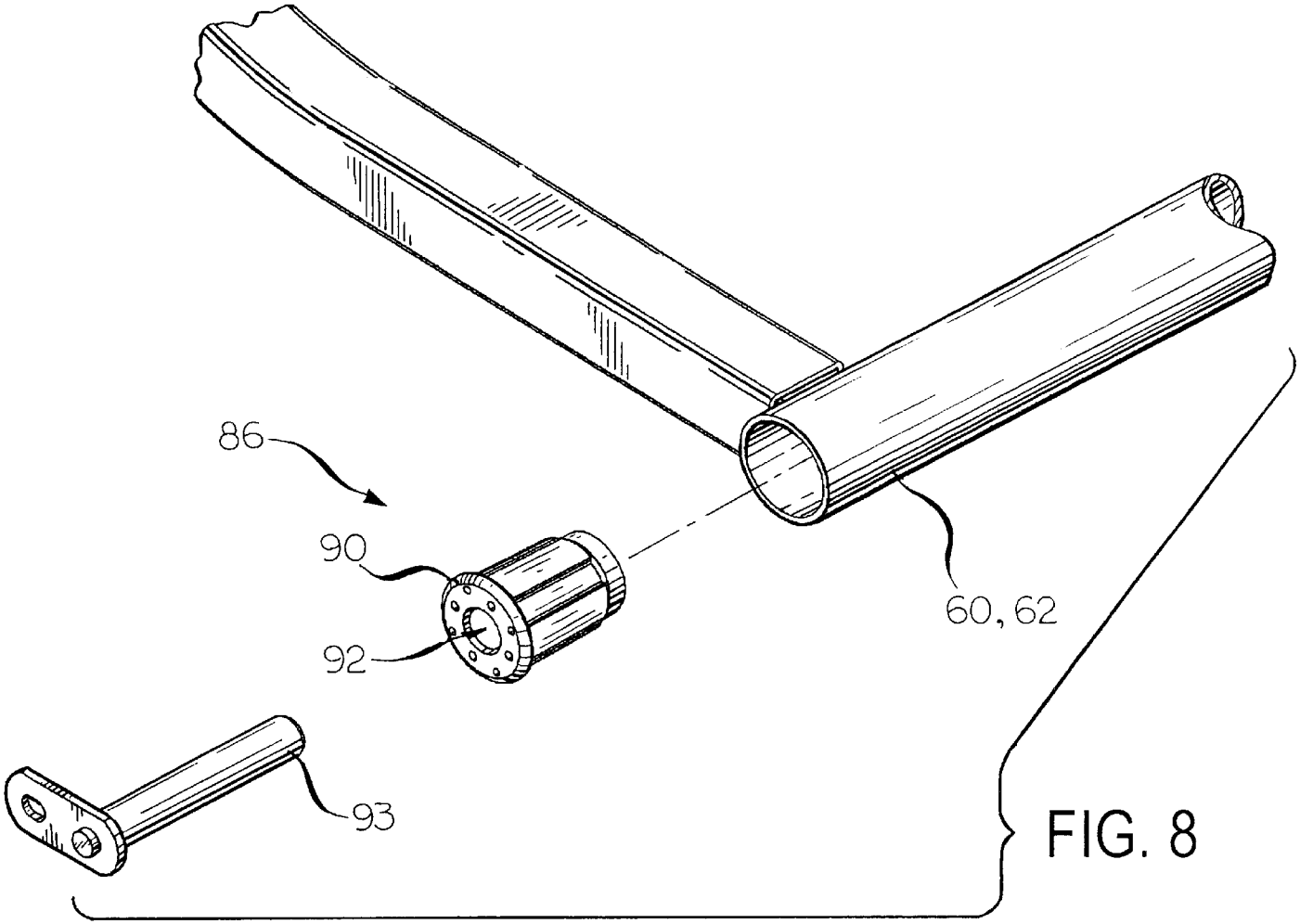
FIG. 8 is an enlarged, exploded perspective view of a bushing adapted for use in the pivotal connections between the stabilizer and the leg and between the stabilizer and the main frame.

As stated above, a medial portion of the bent leg tube 54 is pivotally connected to the short pivot tube 60 of the stabilizer 18. The long pivot tube 62 is pivotally connected to the main frame 14. These pivotal connections may be accomplished through the use of bushings, such as the bushing 86 shown in FIG. 8, which are adapted to be inserted into opposing ends of the pivot tubes 60, 62. The bushings 86 should fit tightly within the ends of the pivot tubes 60, 62 to reduce the risk of slop between the bushings 86 and the pivot tubes 60, 62. The short pivot tube 60 should also fit tightly within the bent leg tube 54 to reduce the risk of lateral slop between the short pivot tube 60 and the bent leg tube 54. Similarly, the long pivot tube 62 should also fit tightly between the side rails 40 of the main frame 14 and more particularly, between stabilizer brackets 88 attached to the head and foot ends of the side rails 40. This reduces the risk of lateral slop between the stabilizer brackets 88 and the long pivot tube 62.

The tight fit between the short pivot tube 60 and the bent leg tube 54 and further between the long pivot tube 62 and the stabilizer brackets 88 may be accomplished in any suitable manner. One manner in which this tight fit may be accomplished is as follows. Resilient low-friction elements may be wedged between the opposing ends of the short pivot tube 60 and the bent leg tube 54 and between the opposing ends of the long pivot tube 62 and the stabilizer brackets 88. Each resilient low-friction element may be an integral part of a bushing 86. For example, at least a portion of each bushing 86 may be formed of a slightly resilient material such as nylon. The slightly resilient portion of each bushing 86 may extend laterally from an opposing end of each pivot tube 60, 62. The travel of each bushing 86 into the pivot tubes 60, 62 may be limited by an annular flange 90 disposed at an outer end of each bushing 86. The travel of the bushings 86 into the pivot tubes 60, 62 may be limited by the abutment of the annular flange 90 with the ends of the pivot tubes 60, 62. The resilient portion of each bushing 86 may be tightly wedged between opposing ends of the short pivot tube 60 and the bent leg tube 54 and between the long pivot tube 62 and the stabilizer brackets 88.

Each bushing 86 is provided with an axial bore 92. Opposing sides of the bent leg tube 54 and the stabilizer brackets 88 are each provided with holes that co-align with the axial bores 92 in the bushings 86. A pivot pin 93 is insertable into and through the holes in the bent leg tube 54 and the stabilizer brackets 88 and further into the axial bore 92 in each of the bushings 86. The pivot pin 93 is preferably machined within a close tolerance of the holes and the axial bores 92 to further reduce the risk of slop at the pivotal connections.

The pivotal connections between the stabilizer 18 and the bent leg tube 54 and between the stabilizer 18 and the stabilizer brackets 88 are provided for illustrative purposes. It may be conceivable that other forms of pivotal connections may be suitable for carrying out the invention. A critical feature of the foregoing pivotal connections is that the risk of slop at the pivotal connections is reduced. This also holds true for the pivot attachment of the sleep surface sections 20, 24 and the main frame 14. The tight pivotal connections or attachments work in cooperation with the toroidal shaped sleep surface sections 20, 24, 22, the main frame 14, the legs 16, and the stabilizers 18 to provide a highly stable bed 10 that is free of noise and undesirable deflection or movement.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A bed comprising:

a sleep surface having at least one section;

a main frame formed from a continuous hoop and supporting the sleep surface; and a pair of opposing legs each formed from a continuous hoop and supporting the main frame, wherein said sleep surface includes a head section and a knee section, each said section being pivotally supported by said main frame, each said section further being in the form of a continuous hoop.

2. The bed according to claim 1, wherein each said continuous hoop is formed from a pair of opposing U-shaped tubular members having opposing legs joined together.

3. The bed according to claim 1, wherein said continuous hoop has a round cross-section.

4. A bed comprising:

a sleep surface having at least one section;

a main frame formed from a continuous hoop and supporting the sleep surface; and a pair of opposing legs formed from a continuous hoop and supporting the main frame, wherein said sleep surface includes a head section, a foot section, and a knee section disposed between said head and foot sections, each said section being in the form of a continuous hoop.

5. The bed according to claim 4, wherein each said continuous hoop is formed from a pair of opposing U-shaped tubular members having opposing legs joined together.

6. The bed according to claim 4, wherein said continuous hoop has a round cross-section.

7. A bed comprising:

a sleep surface having at least one section;

a main frame supporting the sleep surface; and a pair of opposing legs supporting the main frame, wherein said sleep surface, said main frame, and said legs are each continuous closed hoops constructed of tubular material.

8. A bed comprising:

a sleep surface having at least one section formed from a continuous hoop;

a main frame formed from a continuous hoop and supporting the sleep surface; and a pair of opposing legs supporting the main frame, wherein each said leg is formed of a bent leg tube and a laterally extending foot tube, said foot tube being attached to opposing legs of said bent leg tube to form a continuous hoop.

9. The bed according to claim 8, wherein a stabilizer extends between each said leg and said main frame, said stabilizer including a pair of spaced pivot tubes including a short pivot tube and a long pivot tube, said pivot tubes being joined together by opposing stabilizer leg tubes, opposing ends of said stabilizer leg tubes being joined to said pivot tubes so as to form a continuous hoop.

10. The bed according to claim 9, wherein said short pivot tube is dimensioned to fit between said legs of said bent leg tube, said long pivot tube is dimensioned to fit between side rails of said main frame.

11. A bed comprising:

a sleep surface having a head section, and foot section, and a knee section between said head and foot sections, each said section being in the form of a continuous hoop formed from a pair of opposing U-shaped tubular members having opposing legs joined together;

a main frame pivotally supporting said head section and said knee section so that said head and knee sections can be moved between a lowered position and a raised, inclined position, said foot section being pivotally connected to said knee section to permit said foot section to move in response to movement of said knee section, said main frame being in the form of a continuous hoop constructed of tubular material; and a pair of opposing legs supporting said main frame, each one of said legs being pivotally connected to opposing ends of said bed, said legs being in the form of continuous hoops constructed of tubular material.

12. The bed according to claim 11, wherein each said leg is formed of a bent leg tube and a laterally extending foot tube, said foot tube being attached to opposing legs of said bent leg tube.

* * * * *